United States Patent [19]

Brockmeyer et al.

[11] Patent Number: 4,708,326

[45] Date of Patent: Nov. 24, 1987

[54] VENTED POURING CUP FOR MOLTEN METAL CASTING

[75] Inventors: Jerry W. Brockmeyer, Hendersonville; Leonard S. Aubrey, Arden; James E. Dore; Clifford N. Soble, both of Hendersonville, all of N.C.

[73] Assignee: Swiss Aluminium Ltd., Chippis, Switzerland

[21] Appl. No.: 941,809

[22] Filed: Dec. 15, 1986

[51] Int. Cl.[4] ..... B22D 11/10

[52] U.S. Cl. ..... 266/159; 164/437; 222/591; 266/227; 266/275

[58] Field of Search ..... 266/135, 227, 159, 275, 266/276, 277, 278, 144; 222/591; 164/437

[56] References Cited

U.S. PATENT DOCUMENTS

| | | | |
|---|---|---|---|
| 3,516,478 | 6/1970 | Dunn et al. | 266/227 |
| 4,177,066 | 12/1979 | Clumpner | 266/227 |
| 4,179,102 | 12/1979 | Clumpner | 266/227 |
| 4,494,985 | 1/1985 | Butler et al. | 266/227 |
| 4,572,486 | 2/1986 | Groteke et al. | 266/275 |
| 4,591,383 | 5/1986 | McGarry et al. | 266/227 |
| 4,637,593 | 1/1987 | Yinko, Sr. | 266/275 |

*Primary Examiner*—L. Dewayne Rutledge
*Assistant Examiner*—Robert L. McDowell
*Attorney, Agent, or Firm*—Bachman and LaPointe

[57] ABSTRACT

A molten metal pouring cup is provided communicating with a transfer means for transferring molten metal from the pouring cup to a casting station. Vent means is provided on the pouring cup at the interface between the pouring cup and the transfer means to permit release of entrapped gas downstream of the pouring cup.

13 Claims, 8 Drawing Figures

VENTED POURING CUP FOR MOLTEN METAL CASTING

BACKGROUND OF THE INVENTION

When using a pouring cup to supply molten metal for investment, sand or other casting, especially in air melt, non-aspirated foundry applications, problems may arise due to build-up of pressure in the mold as the mold atmosphere is trapped by the incoming metal. The mold cavity has limited permeability and the mold atmosphere is unable to readily escape during the pouring operation.

If the system fails to allow the release of the entrapped mold atmosphere during casting, then pressure builds up in the system slowing the rate of fill of the casting cavity. In the most severe cases, the casting will not fill completely resulting in a misfill and rejection. In lesser cases, the fill time is slowed which may result in casting defects, such as folds, or poor fill in areas of fine detail or in thin sections. Clearly, this is a serious problem which may cause costly rework or even total rejection.

The reduction in flow rate by this pressure build-up is exacerbated when a choke, i.e. a restricted flow are such as a filter, is present in the system which will cause the formation of a metallostatic head and a non-aspirated pouring condition. A molten metal filter, such as the well known ceramic foam filters described in U.S. Pat. No. 3,962,081, offers significant advantages in the removal of particulate from the molten metal so that elimination thereof is not a satisfactory solution.

It is, therefore, a principal object of the present invention to provide an apparatus for casting molten metal which eliminates the problem of pressure build-up in the mold as the mold atmosphere is trapped by the incoming metal.

It is a further object of the present invention to provide an apparatus as aforesaid which operates effectively when a choke is present in the system.

It is a further object of the present invention to provide an apparatus as aforesaid which is simple, convenient and expeditious to use on a commercial scale.

Further objects and advantages of the present invention will appear hereinbelow.

SUMMARY OF THE INVENTION

It has now been found that the foregoing objects and advantages may be readily obtained in accordance with the present invention.

The apparatus of the present invention comprises: a molten metal pouring cup; a source of molten metal upstream of said pouring cup; transfer means communicating with said pouring cup for transferring said molten metal from said pouring cup to a casting station; and vent means on said pouring cup at the interface between said pouring cup and transfer means to permit release of entrapped gas downstream of the pouring cup.

It has been found that this eliminates the problem of pressure build-up caused by entrapped mold atmosphere. Moreover, the simple expedient of the vent means on the pouring cup is particularly easy to employ and operates to eliminate the problem at the side of a choke if employed in the system.

Preferably, the pouring cup has an open top for receiving molten metal and an open bottom communicating with the transfer means, wherein the open bottom has a smaller cross-section than the open top with generally a taper from the open top to the open bottom. A molten metal filter, preferably a ceramic foam filter as described above, is preferably situated in the pouring cup adjacent the open bottom completely blocking molten metal flow through the pouring cup so that the molten metal must pass through the filter with resultant removal of particulate. A resilient peripheral gasket is preferably provided surrounding the filter and sealing the filter to the pouring cup to prevent molten metal leakage around the filter.

Naturally, a plurality of such vent means may be provided to maximize removal of entrapped gas.

DETAILED DESCRIPTION

Figure 1:
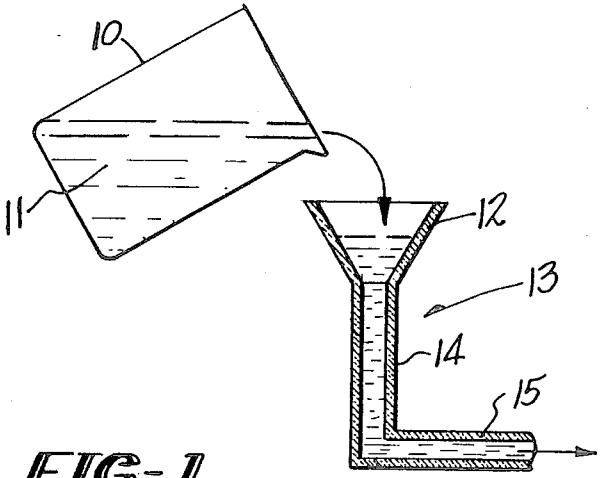
FIG. 1 is a schematic side view of a typical metal pouring operation.

A typical molten metal pouring operation is shown schematically in FIG. 1 wherein a source 10 of molten metal 11 is provided which may be for example top poured as shown or bottom poured or it may be provided directly from the furnace. The molten metal source 10 is upstream of a pouring cup 12 which is then used as a target for pouring and to provide a reservoir of molten metal transfer means 13 communicating with the pouring cup. The molten metal transfer means 13 may consist of a sprue or sprues 14 which lead to one or more runners 15 that ultimately feed the casting cavity or a plurality of casting cavities (not shown). Naturally, the arrangement, size and number of each of these elements will vary from casting to casting.

Figure 2:
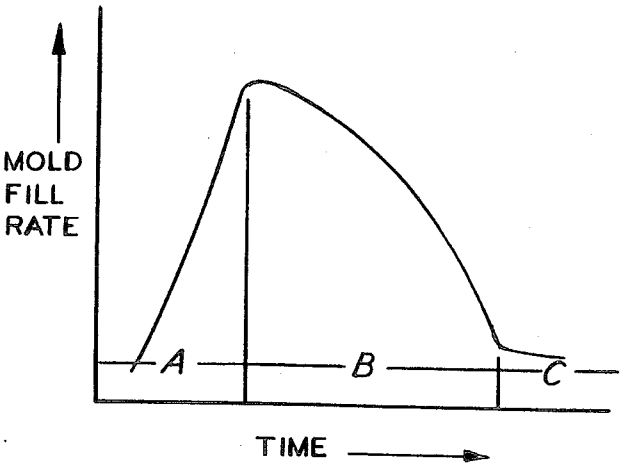
FIG. 2 is a schematic graph showing the mold fill rate as a function of time.

It can be readily seen that the system described may fail to allow the release of the entrapped mold atmosphere, with resultant pressure build-up in the system causing the problems described hereinabove. The mold fill rate as a function of time is schematically shown in FIG. 2 which shows an initial time lag (A) as a metallostatic head builds up, followed by an increase in mold fill rate until excessive pressure builds up in the mold cavity and the mold fill rate declines (B). The mold fill rate may then either plateau (C), continue to fall, or even stop completely, or may climb if the pressure is relieved. As indicated hereinabove, this problem is exacerbated when a choke is present in the system, as a ceramic foam filter.

As indicated hereinabove, it has been found that this problem can be eliminated by the provision of vent means on the pouring cup at the interface between the pouring cup and the molten metal transfer means to permit release of entrapped gas downstream of the pouring cup. FIGS. 3–5 show representative embodiments of the present invention.

Figure 3A:
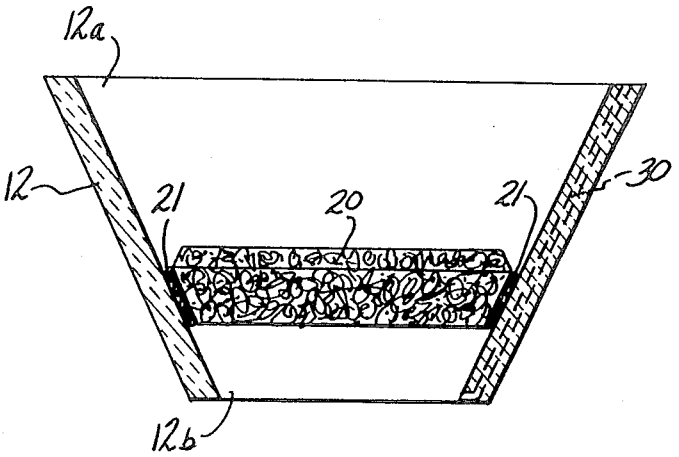
FIGS. 3A, 3B and 3C are side views of pouring cups of the present invention.

FIG. 3A shows pouring cup 12 having an open top 12*a* for receiving molten metal and an open bottom 12*b* with a smaller cross-section than the open top. As can be seen in FIG. 3A, pouring cup 12 tapers from open top 12*a* to open bottom 12*b*. A ceramic foam filter 20 is placed in the pouring cup adjacent open bottom 12*b* completely blocking molten metal flow through the pouring cup so that the molten metal must pass through the ceramic foam filter for particulate removal. The ceramic foam filter shown in FIG. 3A is of the type described in the aforesaid U.S. Pat. No. 3,962,081, the disclosure of which is incorporated herein by reference, although the choke which the filter embodies could be any other flow restriction, as for example another type of filter, a strainer, or a reduction in the flow cross-section. A resilient peripheral gasket 21 is provided surrounding filter 20 and sealing the filter to the pouring cup to prevent molten metal leakage around the filter, to insure that all molten metal flow traverses the filter, and to insure a tight filter placement. The resilient gasket is particularly advantageous as it eliminates filter placement problems due to size and thermal expansion mismatches between the filter and the cup which can result in high mechanical stresses acting on the filter or the cup or both. Naturally, the particular gasket selected will depend on the application, for example, for very high temperature applications such as steel filtration, a pure oxide fiber such as zirconia or alumina fiber is best suited rather than lower temperature aluminosilicate fibers. Also, as shown in FIG. 3A, a bevelled filter matching the peripheral pouring cup contour is preferred for ease of placement.

Figure 3B:
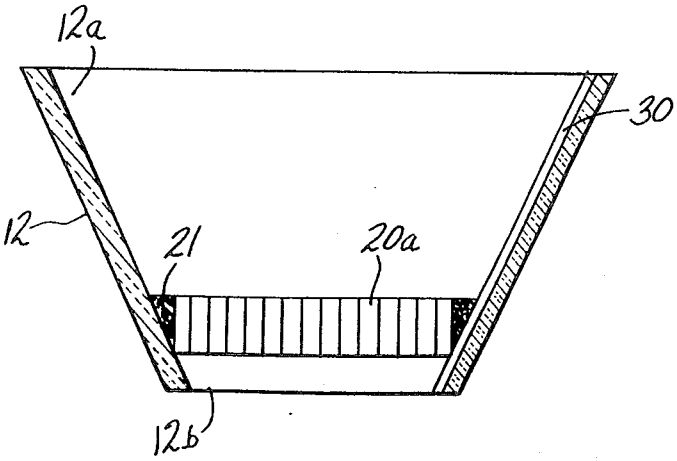
Figure 3:
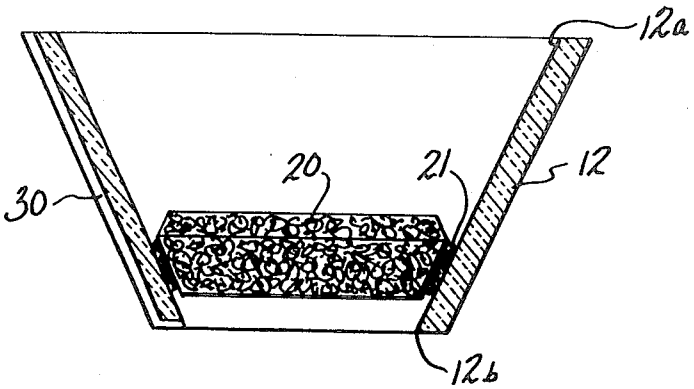

Vent 30 is provided on pouring cup 12, in the embodiment of FIG. 3A formed internally in the wall of the pouring cup and extending across the cup bottom 12*b* as to connect with the sprue. In the embodiment of FIG. 3B, vent 30 is provided by one or more hollow tubes affixed to or integral to the internal surface of the pouring cup 12. FIG. 3C shows vent 30 provided by one or more hollow tubes affixed to or integral to the external surface of pouring cup 12 and again extended to connect with the sprue. The embodiment of FIG. 3B uses a ceramic filter 20a of an extruded ceramic material, while FIG. 3C uses a ceramic foam filter 20 as in FIG. 3A. In both cases, a peripheral gasket material 21 is employed.

Figure 4B:
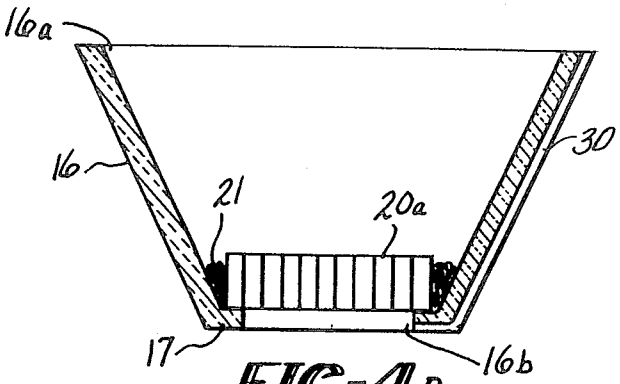
FIGS. 4A and 4B are side views of alternate embodiments of pouring cups of the present invention.
Figure 5:
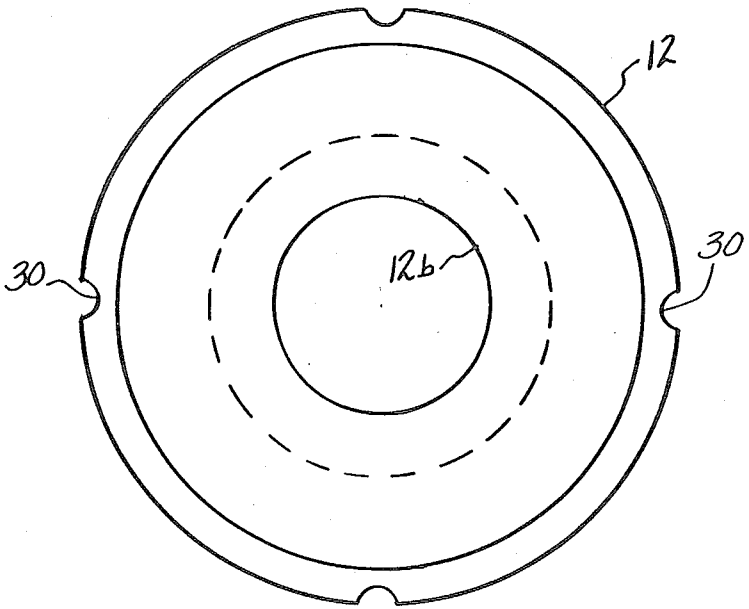
FIG. 5 is a top view of a typical pouring cup of the present invention with a plurality of vent means.
Figure 4A:
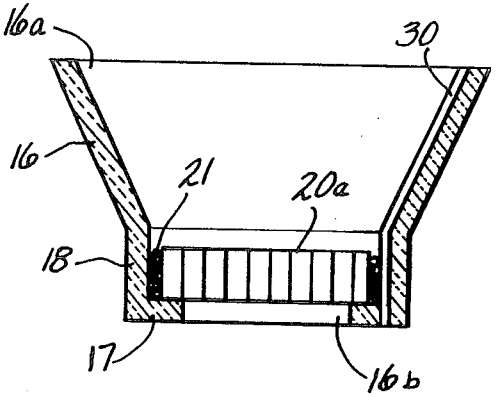

FIGS. 4A and 4B show modified pouring cups 16 including an open top 16*a* and open bottom 16*b* wherein the open bottom has a smaller cross-section than the open top. Open bottom includes an inwardly facing ledge 17 which provides a support surface for filter 20*a* which is of the extruded ceramic type. FIG. 4A includes a pouring cup with generally rectangular bottom portion 18 for convenient placement of a generally rectangular filter, while FIG. 4B shows a continuous pouring cup taper as in FIG. 3.

FIG. 5 is a top view of a pouring cup 12 with four (4) external grooves 30 as vent means. Naturally, the exact number of venting means will vary with requirements. For investment casting, the grooves can be filled with wax and later melted out after build-up of the shell. With no grooves, a vent for investment casting can be formed by affixing wax to the cup surface prior to the shell being formed. In some cases, control of flow in a vented system may also be desired. If so, a limiting orifice or comparable control device could be incorporated in the system.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for casting molten metal which comprises: a molten metal pouring cup; a source of molten metal upstream of said pouring cup; transfer means communicating with said pouring cup for transfering said molten metal from said pouring cup to a casting station; vent means on said pouring cup at the interface between said pouring cup and transfer means to permit release of entrapped gas downstream of the pouring cup.

2. An apparatus according to claim 1, wherein said transfer means includes at least one sprue and at least one runner.

3. An apparatus according to claim 1, wherein said pouring cup has an open top for receiving molten metal and an open bottom communicating with said transfer means, wherein said open bottom has a smaller cross-section than the open top.

4. An apparatus according to claim 3, wherein said pouring cup tapers from said open top to said open bottom.

5. An apparatus according to claim 3, including a molten metal filter means in said pouring cup adjacent the open bottom completely blocking molten metal flow through said pouring cup so that the molten metal must pass through said filter means.

6. An apparatus according to claim 5, including a resilient peripheral gasket surrounding said filter means and sealing the filter means to said pouring cup to prevent molten metal leakage around the filter means.

7. An apparatus according to claim 1, wherein said vent means is located within the pouring cup wall.

8. An apparatus according to claim 1, wherein said vent means is located inside the pouring cup.

9. An apparatus according to claim 1, wherein said vent means is located outside the pouring cup.

10. An apparatus according to claim 1, including a plurality of said vent means.

11. An apparatus according to claim 5, wherein said open bottom includes an inwardly facing ledge supporting said molten metal filter.

12. An apparatus according to claim 11, wherein said open bottom includes a generally rectangular portion for receiving said filter.

13. An apparatus according to claim 1, wherein said vent means comprises internal pouring cup tubes.

* * * * *

UNITED STATES PATENT AND TRADEMARK OFFICE

CERTIFICATE OF CORRECTION

PATENT NO. : 4,708,326

DATED : November 24, 1987

INVENTOR(S) : Jerry W. Brockmeyer et al.

It is certified that error appears in the above-identified patent and that said Letters Patent is hereby corrected as shown below:

In the Drawings, Sheet 2, delete "Fig-3" and insert --Fig-3C--.

Column 1, line 25, delete "are" and insert --area--.

Column 3, line 44, after "bottom" insert --16b--.

Signed and Sealed this

Thirty-first Day of May, 1988

*Attest:*

*Attesting Officer*

DONALD J. QUIGG

*Commissioner of Patents and Trademarks*